US007967580B2

(12) United States Patent
Wöckel et al.

(10) Patent No.: US 7,967,580 B2
(45) **Date of Patent: *Jun. 28, 2011**

(54) OIL PUMP FOR AN INTERNAL COMBUSTION ENGINE

(75) Inventors: Norman Wöckel, Weissach (DE); Jürgen Bohner, Bad Waldsee (DE); Kurt Schlegel, Hohentengen (DE); Sven Peters, Eberhardzell (DE); Paul Wahl, Bad Schussenried (DE); Hilmar Gärtner, Bad Saulgau (DE)

(73) Assignee: Dr. Ing h.c. F. Porsche AG, Stuttgart (DE)

( * ) Notice: Subject to any disclaimer, the term of this patent is extended or adjusted under 35 U.S.C. 154(b) by 99 days.

This patent is subject to a terminal disclaimer.

(21) Appl. No.: 12/356,829

(22) Filed: Jan. 21, 2009

(65) Prior Publication Data

US 2009/0123314 A1 May 14, 2009

Related U.S. Application Data

(63) Continuation of application No. 11/474,212, filed on Jun. 23, 2006, now Pat. No. 7,544,052.

(30) Foreign Application Priority Data

Jun. 23, 2005 (DE) ..... 10 2005 029 086

(51) Int. Cl.
*F03C 4/00* (2006.01)
*F04C 2/00* (2006.01)

(52) U.S. Cl. ..... 418/21; 418/9; 418/16; 417/251; 417/307; 184/6.21; 184/6.23

(58) Field of Classification Search ..... 418/21, 418/16, 9; 417/251, 307; 184/6.21, 6.23
See application file for complete search history.

(56) References Cited

U.S. PATENT DOCUMENTS

| | | | |
|---|---|---|---|
| 5,267,415 | A | 12/1993 | Vaughan |
| 5,987,821 | A | 11/1999 | Heim et al. |
| 6,811,383 | B2 | 11/2004 | Maier |

FOREIGN PATENT DOCUMENTS

| | | | |
|---|---|---|---|
| DE | 3816347 | A1 | 11/1989 |
| DE | 19639280 | A1 | 3/1998 |
| DE | 10038200 | A1 | 2/2002 |
| DE | 10144693 | A1 | 3/2003 |
| DE | 10159088 | A1 | 6/2003 |
| EP | 1316683 | A2 | 6/2003 |
| JP | 61212680 | A | 9/1986 |

*Primary Examiner* — Theresa Trieu

(57) ABSTRACT

An oil pump for an internal combustion engine for drawing up the lubricating oil situated in an oil collector device has an oil pump housing wherein at least two pairs of gears are disposed. The pairs of gears, in order to form the pumping stages, are connected on the suction side to a suction passage formed in the oil pump housing and on the delivery side to a delivery passage. The oil pump housing is further formed with an oil supply passage that is connected to the suction passage of a first pumping stage and via which lubricating oil can be delivered to the suction side of the first pumping stage.

2 Claims, 4 Drawing Sheets

FIG. 3
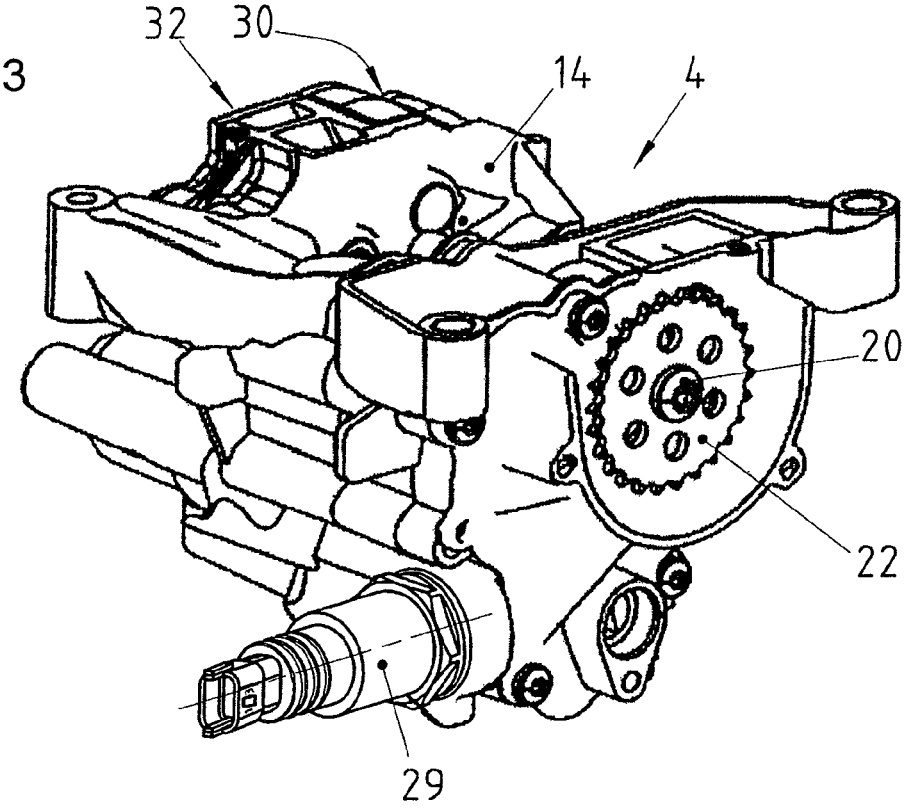
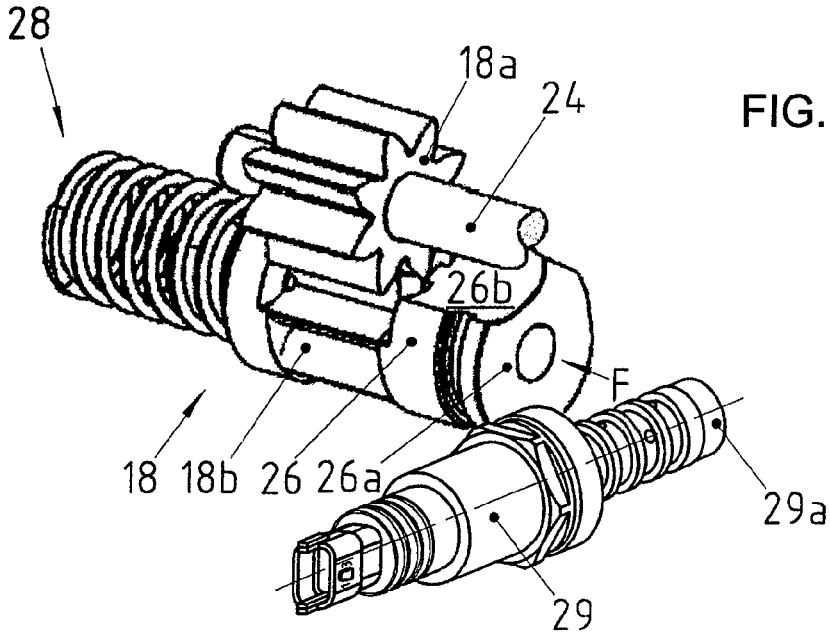
FIG. 4

OIL PUMP FOR AN INTERNAL COMBUSTION ENGINE

CROSS-REFERENCE TO RELATED APPLICATIONS

This is a continuation of application Ser. No. 11/474,212, filed Jun. 23, 2006 now U.S. Pat. No. 7,544,052; the application also claims the priority, under 35 U.S.C. §119, of German patent application No. DE 10 2005 029 086.8, filed Jun. 23, 2005; the prior applications are herewith incorporated by reference in their entirety.

BACKGROUND OF THE INVENTION

Field of the Invention

The invention relates to an oil pump for an internal combustion engine. The oil pump is provided for the purpose of drawing up the lubricating oil from an oil collector device. The pump has an oil pump housing wherein at least two pairs of gears are disposed. The pairs of gears, in order to form the pumping stages, are connected on the suction side to a suction passage formed in the oil pump housing and on the delivery side to a delivery passage.

Commonly assigned German published patent application DE 101 59 088 describes a gear oil pump for the supply of lubricating oil to an internal combustion engine, wherein the lubricating oil is delivered from a rear oil suction space of an oil collector housing of the internal combustion engine via a first pumping stage into the actual oil sump in order to be supplied from there via a second pumping stage to the consumers, such as, for example, the main bearings of the crankshaft or the bearings of the camshaft, etc. Particularly during relatively long downhill sections, the first pumping stage may suck up air, with the result that the relevant pair of gears of the pumping stage is not, under some circumstances, sufficiently lubricated. Sufficient lubrication of the gears is required in particular if pumping stages connected downstream are driven via the relevant pumping stage and therefore a corresponding torque has to be transmitted.

SUMMARY OF THE INVENTION

It is accordingly an object of the invention to provide an oil pump for an internal combustion engine which overcomes the above-mentioned disadvantages of the heretofore-known devices and methods of this general type and which provides for an oil pump configured as a gear pump, which ensures that the intermeshing pairs of gears are permanently and reliably lubricated in all operating situations of the internal combustion engine, i.e., of the motor vehicle.

With the foregoing and other objects in view there is provided, in accordance with the invention, an oil pump for an internal combustion engine for drawing up lubricating oil from an oil collector device. The pump comprises:

- an oil pump housing formed with a suction passage and a delivery passage;
- at least two pairs of gears disposed in said oil pump housing, said pairs of gears defining respective pumping stages with a suction side connected to said suction passage and a delivery side connected to said delivery passage;
- said oil pump housing being formed with an oil supply passage communicating with said suction passage of a first pumping stage and enabled to deliver lubricating oil to the suction side of the first pumping stage.

In other words, lubricating oil is delivered through the oil supply passage formed in the oil pump housing to the suction side of the pumping stage of the oil pump, thus ensuring that the two gears forming the pumping stage are reliably and dependably lubricated. Even in operating states wherein sometimes no lubricating oil is delivered by the pumping stage, lubricating oil delivered, for example, by another pumping stage can be delivered via the oil supply passage to the suction side of the pumping stage and can therefore ensure that the gears are lubricated, in particular on the tooth engagement surfaces of the two pump gears and on the boundary walls of the pump chamber.

In accordance with an added feature of the invention, the lubrication of the gears on the suction side of the first pumping stage advantageously takes place via the second pumping stage—the actual delivery stage of the oil pump—since the latter delivers a sufficient amount of lubricating oil from the oil sump of the oil collector housing in all operating states of the engine or of the motor vehicle.

In accordance with an additional feature of the invention, a variable deliverable volume is realized in that the delivery stage is provided with an adjusting device that has an electrically activatable regulating valve which at the same time ensures that lubricating oil is supplied via the oil supply passage to the suction side of the first pumping stage.

The axially displaceable output gear of the second pumping stage is bounded on at least one end side by a first pressure chamber integrated in the oil pump housing; the delivery volume of the delivery stage can therefore be correspondingly changed or matched to the operating state of the engine.

In a second (pressure) chamber arranged on the other end side of the output gear, there is a spring element, the spring force of which works against the hydraulic adjusting force applied in the first pressure chamber.

Since only a certain maximum oil pressure, for example 2 bar, can be set with the spring element and in order to be able to vary the oil pressure in the engine, the second (pressure) chamber is likewise subjected to hydraulic oil if the need arises. Different oil pressures can therefore be set independently of the rotational speed of the engine.

In accordance with another feature of the invention, the relieving of the second (pressure) chamber from pressure takes place via the oil supply passage which is integrated in the oil pump housing and leads to the suction side of the first pumping stage. Normally, the hydraulic oil situated in the second (pressure) chamber would be recycled to the oil tank or to the oil sump; it is used here in an advantageous manner for the suction-side lubrication of the pair of gears of the first pumping stage.

The output gear of the second pumping stage together with two piston elements arranged on its end surfaces forms a constructional unit, with the free end surface of the two piston elements serving, inter alia, as active surfaces for the hydraulic displacement of the output gear.

In accordance with a concomitant feature of the invention, the piston element assigned to the pressure chamber is of stepped design, with the piston section that is reduced in diameter serving, inter alia, as guide for the spring element which is designed as a spiral spring.

Other features which are considered as characteristic for the invention are set forth in the appended claims.

Although the invention is illustrated and described herein as embodied in an oil pump for an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

FIG. 3 is a perspective view of the oil pump according to the invention;

FIG. 4 shows the internal construction of the oil pump;

DESCRIPTION OF THE PREFERRED EMBODIMENTS

Figure 1:
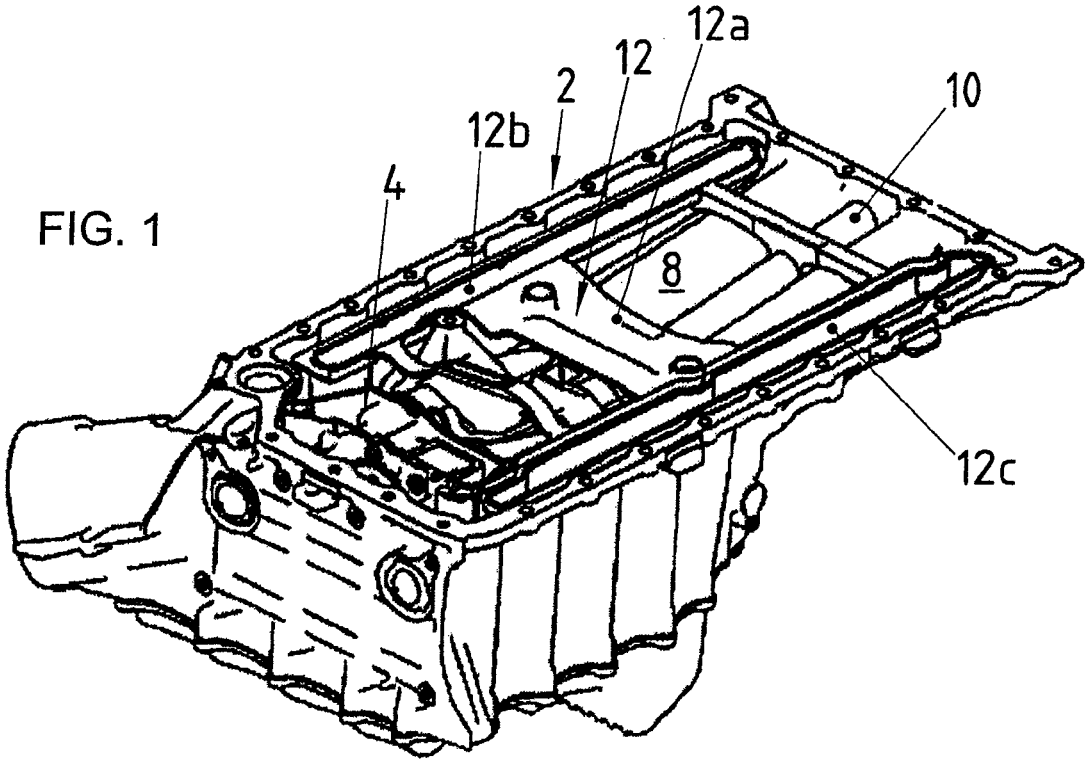
FIG. 1 is a perspective view of an oil-conducting housing with an oil pump arranged therein.
Figure 2:
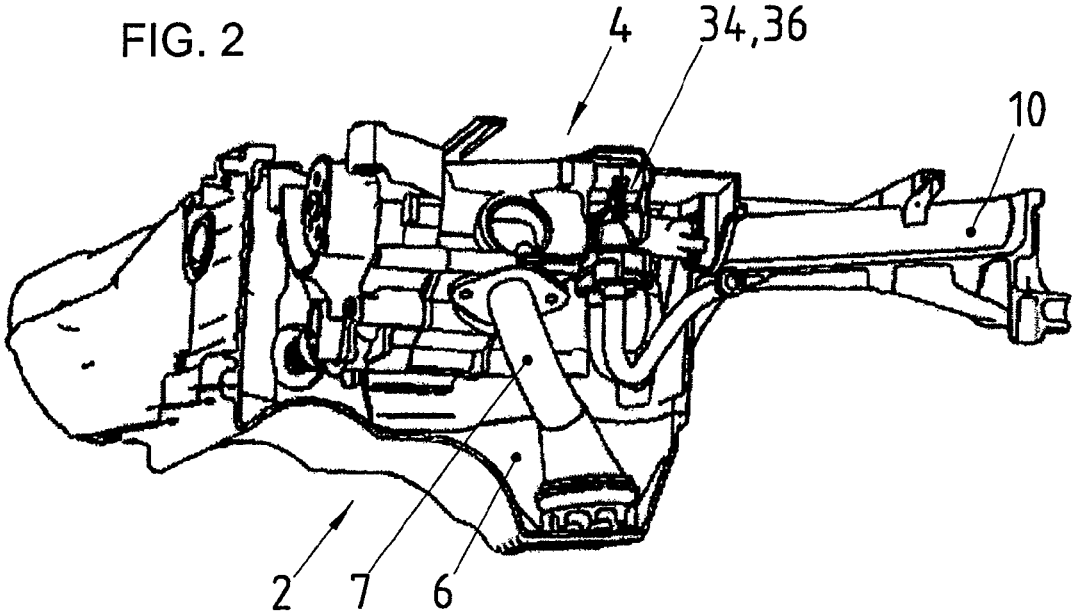
FIG. 2 is a longitudinal section through the oil-conducting housing.

Referring now to the figures of the drawing in detail and first, particularly, to FIGS. 1 and 2 thereof, there is shown an oil collector housing, referred to below as an oil pan 2, and a lubricating oil pump 4 designed as a double pump. The oil pan 2 is formed with a first oil-collecting space 6 wherein the oil necessary for the supply of lubricating oil collects in an oil sump, the lubricating oil being drawn up via an oil suction pipe 7. A second, rear oil-collecting space 8 wherein a second oil suction pipe 10 is arranged is formed in the oil pan 2. The first and the second oil-collecting spaces 6, 8 are separated from one another by an insert part 12—comprising a central part 12*a* and two side parts 12*b* and 12*c*. In the second oil-collecting space 8, the lubricating oil from the main bearings of the crankshaft and the lubricating oil from the non-illustrated spray nozzles for the cooling of the pistons is collected and recycled via the oil suction pipe 10, which is connected to the suction side of a first pumping stage 16 of the lubricating oil pump 4, into the first oil-collecting space 6. The lubricating oil is delivered from there via a second pumping stage 18 of the oil pump 4 to the consumers.

Figure 5:
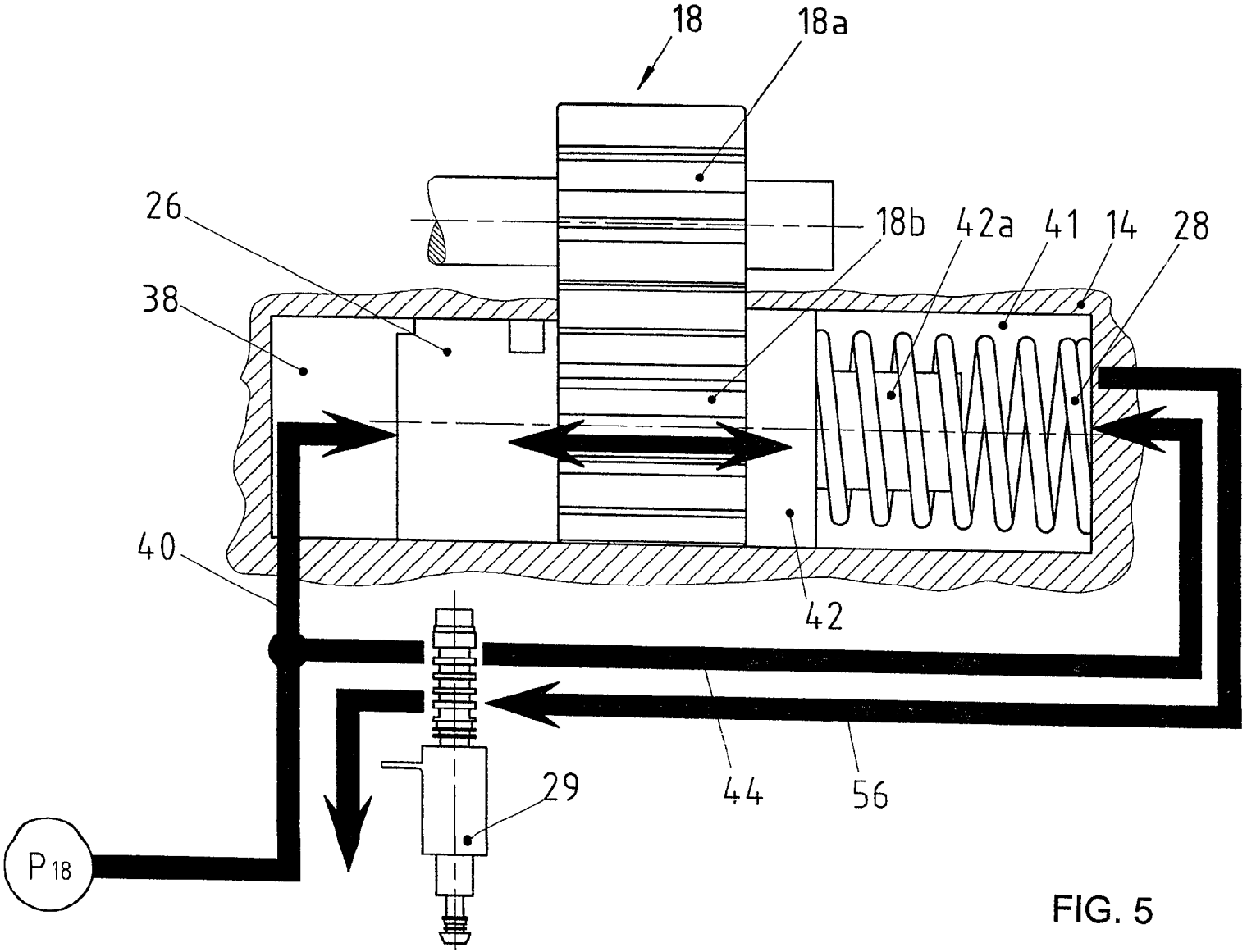
FIG. 5 shows a diagrammatic illustration of the regulation of the oil pump.

The two pumping stages 16, 18 formed in the housing 14 of the oil pump 4 are formed by in each case two intermeshing gears 16*a* and 16*b* (FIG. 6) or 18*a* and 18*b* (FIGS. 4 and 5). The driving gear 16*a* of the first pumping stage 16 is mounted to a first pump shaft 20 which is driven on the end side via a chain gear 22. The driving gear 18*a* of the second pumping stage 18 is arranged on a second pump shaft 24. The output gear 18*b* of the second pumping stage 18 is held in an axially displaceable manner in the housing 14 of the oil pump 4 and is combined with an adjusting piston 26 to form a constructional unit. On that end side of the output gear 18*b* which is opposite the adjusting piston 26 there is arranged a spiral spring 28 which, during an axial displacement of the output gear 18*b*—caused by the application of a hydraulic force F to the end side 26*a* of the adjusting piston 26—is correspondingly compressed. On its circumferential surface, the adjusting piston 26 has a recess 26*b* which is in the shape of an arc of a circle and serves to receive the driving gear 18*a* during an axial displacement of the adjusting piston 26. The axial displacement of the output gear 18*b* takes place hydraulically via the adjusting piston 26—as will be explained in more detail further below; for this purpose, an electrically actuatable control valve 29 is provided which is screwed in the housing 14 of the oil pump 4 and opens up corresponding oil channels or passages which are integrated in the housing 14 and via which a pressurization of the adjusting piston 26 takes place.

Two further pumping stages 30 and 32 (FIG. 3) designed as pairings of gears are also driven via the first pump shaft 20. The two pumping stages 30 and 32 form two turbocharger suction pumps which suck up the lubricating oil delivered via the second pumping stage 18 to the exhaust gas turbochargers and recycle it into the first oil-collecting space 6.

FIG. 5 illustrates in more precise detail the principle of regulating the delivery quantity or oil pressure of the variable lubricating oil pump 4. As mentioned above, the output gear 18*b* of the second pumping stage 18—the actual delivery stage—is held in an axially displaceable manner in the oil pump housing 14. For this purpose, a first pressure chamber 38 is formed on the side of the adjusting piston 26, which pressure chamber can be connected by an oil passage 40 or oil channel (only illustrated diagrammatically) to the delivery outlet $P_{18}$ of the second pumping stage 18 via the control valve 29. A second pressure chamber 41 wherein the spiral spring 28 is accommodated is formed on the opposite side. On this side, the output gear 18*b* is provided on the end side with an adjusting piston of stepped design—referred to below as stepped piston 42. In this case, the piston section 42*a* provided with the smaller diameter serves as guide for the spiral spring 28 and as end stop for the axial displacement of the output gear 18*b*. The second pressure chamber 41 can also be connected via an oil passage 44 to the delivery outlet $P_{18}$ of the second pumping stage 18; control likewise takes place here via the valve 29.

With this regulating device, different oil delivery quantities or different oil pressures can be set. If, for example, only the first pressure chamber 38 is connected to the delivery outlet $P_{18}$ of the second pumping stage 18, then only the spiral spring 28 works against the hydraulic force applied on the end side of the adjusting piston 26. At an oil pressure of, for example, 2 bar ($2\times10^5$ Pa), the spring force is overcome and the output gear 18*b* or the entire constructional unit is displaced to the right—with reference to the illustration in FIG. 5.

If higher oil pressures are required for a sufficient supply of lubricating oil, for example at high rotational speeds of the engine and high oil temperatures, then the second pressure chamber 41 is likewise connected to the delivery outlet $P_{18}$ of the second pumping stage 18.

Figure 6:
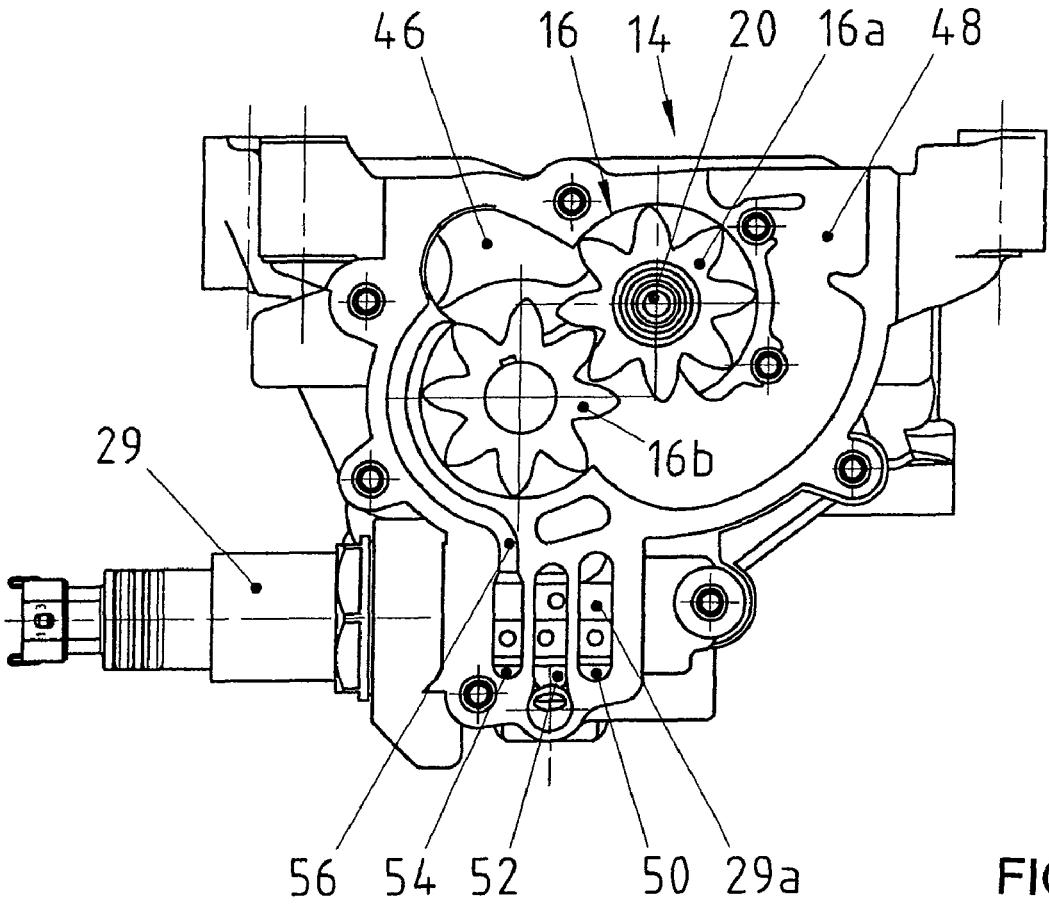
FIG. 6 shows an inside view of the oil pump in the region of a suction stage.

FIG. 6 illustrates that part of the oil pump housing 14 wherein the first pumping stage 16 with the two gears 16*a*, 16*b* is accommodated. The pumping stage 16 has a suction passage 46 forming the intake side and a delivery passage 48 (i.e., delivery channel 48) separated from the suction passage 46 by the two intermeshing gears 16*a*, 16*b*. Furthermore, three openings 50, 52 and 54 which are in the form of elongated holes and which are monitored by the valve body 29*a* of the valve 29 are placed in the flange surface of the housing part. The opening 50 is connected to the first pressure chamber 38 and the opening 52 is connected to the second pressure chamber 41. The opening 54 is connected to a return passage—referred to below as oil supply passage 56, or oil supply channel 56—which is integrated in the oil pump housing 14, leads to the suction side of the first pumping stage 16 and opens into the suction passage 46. To regulate the oil pressure, the activation of the valve 29 is pulse-width-modulated (PWM signal); as a result, a "leakage" oil flow is permanently delivered via the oil supply passage 56 onto the suction side of the pumping stage 16. This ensures that the pair of gears 16*a*,

16*b* on the suction side is lubricated even in situations wherein no lubricating oil is drawn up by the first pumping stage 16.

This application claims the priority, under 35 U.S.C. §119, of German patent application DE 10 2005 029 086.8, filed Jun. 23, 2005; the prior application is herewith incorporated by reference in its entirety.

We claim:

1. An oil pump for an internal combustion engine for drawing up lubricating oil from an oil collector device, comprising:

an oil pump housing having a first oil collecting space, an insert part, a second oil collecting space separated from said first oil collecting space by said insert part, and formed with a suction passage and a delivery passage;

at least two pairs of gears disposed in said oil pump housing, said pairs of gears defining respective pumping stages with a suction side connected to said suction passage and a delivery side connected to said delivery passage;

an oil supply passage integrated in said oil pump housing, said oil supply passage communicating with said suction passage of a first pumping stage and enabled to deliver lubricating oil to the suction side of said first pumping stage, said suction side of the first pumping stage directly communicating with both said second oil collecting space and said oil supply passage.

2. The oil pump according to claim 1, wherein the lubricating oil supplied to said suction side of said first pumping stage via said oil supply passage is delivered via a second pumping stage of said pumping stages.

* * * * *

UNITED STATES PATENT AND TRADEMARK OFFICE

CERTIFICATE OF CORRECTION

PATENT NO. : 7,967,580 B2
APPLICATION NO. : 12/356829
DATED : June 28, 2011
INVENTOR(S) : Wöckel et al.

It is certified that error appears in the above-identified patent and that said Letters Patent is hereby corrected as shown below:

On Title Page:

Item (73) should read as follows:

(73) Assignees: Dr. Ing. h.c. F. Porsche Aktiengesellschaft, Stuttgart (DE)

Schwäbische Hüttenwerke Automotive GmbH, Aalen (DE)

Signed and Sealed this
Twenty-fourth Day of July, 2012

David J. Kappos
*Director of the United States Patent and Trademark Office*